US007578150B2

(12) United States Patent
Zsambeki

(10) Patent No.: US 7,578,150 B2
(45) Date of Patent: Aug. 25, 2009

(54) DETERGENT DISPENSER FOR A WASHING MACHINE

(75) Inventor: Marcus Zsambeki, Flacht (DE)

(73) Assignee: Whirlpool Corporation, Benton Harbor, MI (US)

( * ) Notice: Subject to any disclaimer, the term of this patent is extended or adjusted under 35 U.S.C. 154(b) by 638 days.

(21) Appl. No.: 11/067,254

(22) Filed: Feb. 25, 2005

(65) Prior Publication Data

US 2005/0188730 A1 Sep. 1, 2005

(30) Foreign Application Priority Data

Feb. 27, 2004 (EP) ..... 04004534

(51) Int. Cl.
*D06F 39/02* (2006.01)

(52) U.S. Cl. ..... 68/17 R; 134/93

(58) Field of Classification Search ..... 68/17 R; 134/93; 222/325; 422/266
See application file for complete search history.

(56) References Cited

U.S. PATENT DOCUMENTS 5,473,914 A * 12/1995 Pyo et al. ..... 68/17 R
5,588,313 A * 12/1996 Hildebrand ..... 68/17 R
5,613,379 A * 3/1997 Kim ..... 68/17 R
5,675,994 A * 10/1997 Gweon ..... 68/17 R
6,227,012 B1 * 5/2001 Borroni et al. ..... 68/17 R
7,093,467 B2 * 8/2006 Kim et al. ..... 68/17 R
2003/0172690 A1 * 9/2003 Kim et al. ..... 68/17 R

FOREIGN PATENT DOCUMENTS

DE 2126240 8/1972
FR 2103661 * 4/1972
GB 2022622 A 12/1979

OTHER PUBLICATIONS

Electronic translation of FR2103661.*
English translation of FR 2103661, date not applicable.*

* cited by examiner

*Primary Examiner*—Joseph L Perrin
(74) *Attorney, Agent, or Firm*—Clifton G. Green; McGarry Bair, P.C.

(57) ABSTRACT

A detergent dispenser for a washing machine comprises a box shaped recess and a washing agent drawer slidably mounted in the recess, such drawer being provided with a plurality of separate compartments for containing wash and/or rinse products to be flushed by an incoming water flow into the tub of the washing machine. The detergent dispenser has a channel in the bottom of the recess for directing the incoming water flow towards a predetermined zone of the box shaped recess without flowing through the drawer.

11 Claims, 2 Drawing Sheets

DETERGENT DISPENSER FOR A WASHING MACHINE

BACKGROUND OF THE INVENTION

1. Field of the Invention

The present invention relates to a detergent dispenser for a washing machine comprising a box shaped recess and a washing agent drawer which is slidably mounted in the recess, such drawer being provided with a plurality of separate compartments for containing wash and/or rinse products to be flushed by an incoming water flow into the tub of the washing machine.

2. Description of the Related Art

In washing machines known in the art, a detergent drawer provides the transfer of various washing agents to the tub after being mixed with water. In such machines, particularly front-loading clothes washing machines, water is fed into detergent compartments located in the drawer via a water distribution device placed over it. In this case, the wash and/or rinse products that are loaded by the user in the drawer (by simply pulling out the drawer) are directed to an outlet of the recess in which the detergent drawer is placed, and transferred together to the tub with the water.

In the known solutions detergent residues accumulate between the recess and the drawer by the time. In order to avoid this problem, the residual detergent accumulated in the recess has to be removed by the user periodically. This manual operation is not easy mainly due to the long and slim geometrical structure of the recess.

SUMMARY OF THE INVENTION

The present invention provides a detergent dispenser for a washing machine allowing effective transfer of the washing agents contained in the drawer to the tub in such manner that all residual washing agents are removed from the recess in which the drawer is placed.

A further embodiment of the invention is to provide a detergent dispenser for a washing machine in which the water can be fed into the tub without the need of passing through any of the compartments containing washing agents.

As will become apparent from the following description, the illustrated embodiments of the invention provides a detergent distributor for detergents in powder and liquid form which prevents the residual washing agents from sticking onto the inner wall of the recess in which the drawer is slidably mounted.

DETAILED DESCRIPTION

Figure 1:
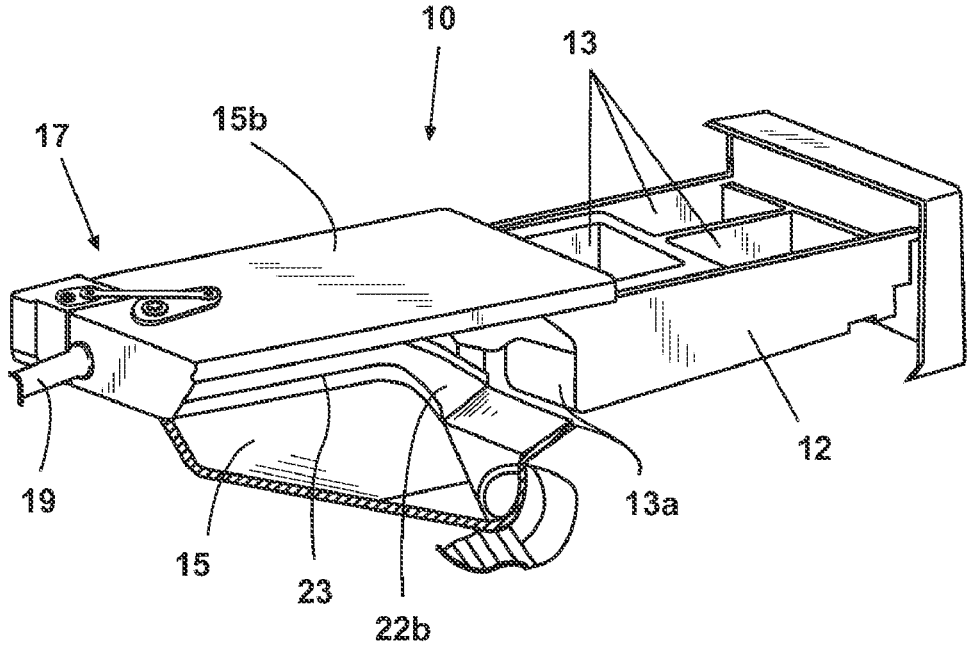
FIG. 1 is a partially sectioned perspective view of a detergent dispenser according to the invention, in a drawn out configuration of the drawer.
Figure 2:
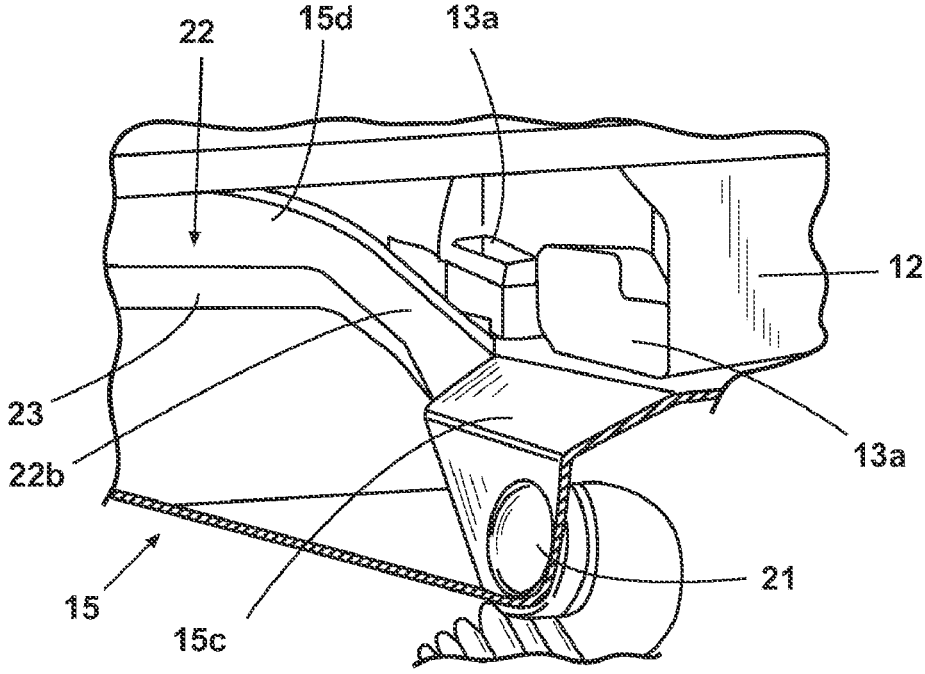
FIG. 2 is an enlarged view of a detail of FIG. 1.
Figure 3:
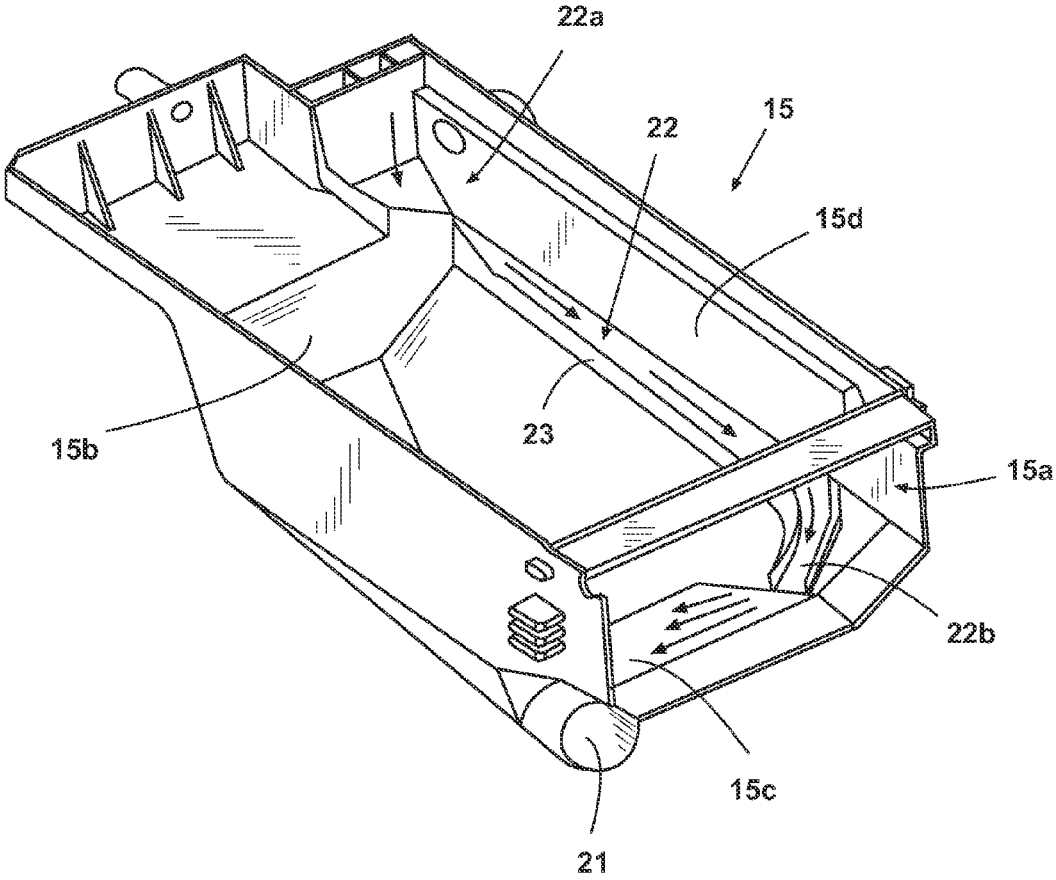
FIG. 3 is perspective view of the funnel-shaped recess of FIG. 1.

FIG. 1 depicts a detergent dispenser 10 which is installed in the usual way in the upper portion of a front-loading washing machine (not shown), particularly of a drum-type clothes washing machine or combined clothes washing and drying machine, and is constituted by a drawer 12 provided with a plurality of separate compartments 13 intended to contain the various washing detergents and/or rinsing aids to be added in a selective manner into the wash tub of the washing machine where they will be used for carrying out the various steps and phases of each selected clothes washing process. The drawer 12 is slidingly mounted through a front opening 15*a* of box shaped recess 15 installed in the front upper portion of the washing machine, just below the top surface of the machine. The recess 15 is covered by a lid 15*b* supporting a water distribution device 17 for selectively directing an incoming flow of fresh water (from a hose 19) towards the compartments 13 in order to flush content thereof. Once the water has passed through the compartments 13, the mixture of water and washing agent passes through openings 13*a* placed in the rear portion of the drawer, is carried to the rear portion 15*b* of the recess 15, and then to an opening 21 for discharge into the tub of the machine. Such flow is enhanced by the funnel shape of the recess 15. Due to the above mentioned flow pattern, on a front region of the recess 15, particularly on a slanted surface 15*c* adjacent the front opening 15*a*, there can be a build-up of detergent residuals. In order to avoid such build-up, the recess 15 is provided on its bottom surface, on a side thereof, with a channel 22 defined by a side wall 15*d* of the recess and by a sort of dam 23 parallel to the side wall 15*d*. The channel 22 presents a feeding end portion 22*a* fed by the water distributor device 17 and a guidance or second end curved portion 22*b* which directs the water flow towards the slanted surface 15*c*. The fresh water fed to the end portion 22*a* of the channel 22 is therefore guided to the surface 15*c* and cleans this area from detergent residuals.

Another important advantage of the present invention is that it is possible to bypass all the washing agent compartments 13 (three are shown in the example) and to bring fresh water into the tub at any time of the wash program.

Even if in the example the channel 22 is shown on the bottom side of the recess 15 on a side thereof, the location of such channel could be different and dependent on the position of the zone where the water flow has to be directed.

I claim:

1. A washing machine, comprising:

a detergent dispenser comprising:

a recess having a bottom, a front end, a rear end, and opposing sides connecting the front and rear ends, with a discharge opening in the bottom near the front end, a washing agent drawer slideably mounted in the recess and having a plurality of separate compartments for containing wash and/or rinse products, a channel shaped portion provided in the recess and extending from the rear end to the front end and at a location above the discharge opening; and a distribution device selectively supplying water to the compartments and channel wherein when the water is supplied to the channel, the channel directs water generally from the rear end to the front end and across the front end above the discharge opening to flush the portion of the recess above the discharge opening without directing water through the drawer.

2. The washing machine of claim 1, wherein the channel shaped portion of the detergent dispenser is placed substantially on the bottom of the recess.

3. The washing machine of claim 2, in which the bottom of the recess is funnel-shaped and presents, at its end near the drawer opening, a slanted surface, wherein the channel shaped portion presents, at its front end, a guidance for directing the water flow substantially towards the slanted surface.

4. The washing machine of claim 1 wherein the recess has a box-like shape formed by the opposing sides and front and rear ends.

5. The washing machine of claim 4 wherein the channel shaped portion extends from the water supply inlet at the rear end, along one of the opposing sides, to the front end above the discharge opening.

6. The washing machine according to claim 1 wherein the front of the recess is adjacent a front of the washing machine.

7. A washing machine, comprising:

a detergent dispenser comprising:

a funnel-shaped recess defined by a peripheral wall having front and rear ends connected by opposing sides converging to a discharge opening near the front end, a channel shaped portion provided in the recess and extending from the rear end to the front end and at a location above the discharge opening; and a distribution device selectively supplying water to the channel wherein when the water is supplied to the channel, the channel directs water generally from the rear end to the front end and across the front end above the discharge opening to flush the portion of the recess above the discharge opening.

8. The washing machine of claim 7 wherein the recess has a box-like shape formed by the opposing sides and front and rear ends.

9. The washing machine of claim 7 wherein the channel shaped portion extends from the water supply inlet at the rear end, along one of the opposing sides, to the front end above the discharge opening.

10. The washing machine according to claim 7 further comprising a washing agent drawer slideably mounted in the recess and having a plurality of compartments for containing wash and/or rinse products.

11. The washing machine according to claim 7 wherein the front of the recess is adjacent a front of the washing machine.

* * * * *

UNITED STATES PATENT AND TRADEMARK OFFICE

CERTIFICATE OF CORRECTION

PATENT NO. : 7,578,150 B2
APPLICATION NO. : 11/067254
DATED : August 25, 2009
INVENTOR(S) : Marcus Zsambeki It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 848 days.

Signed and Sealed this

Seventh Day of September, 2010

David J. Kappos

David J. Kappos
*Director of the United States Patent and Trademark Office*